United States Patent [19]

Liebe et al.

[11] 4,379,828

[45] Apr. 12, 1983

[54] IMAGE RECEPTOR ELEMENT FOR THE DYE DIFFUSION TRANSFER PROCESS

[75] Inventors: Werner Liebe; Karl Lohmer, both of Leverkusen; Willibald Pelz, Cologne, all of Fed. Rep. of Germany

[73] Assignee: Agfa-Gevaert Aktiengesellschaft, Leverkusen, Fed. Rep. of Germany

[21] Appl. No.: 263,584

[22] Filed: May 14, 1981

[30] Foreign Application Priority Data

May 16, 1980 [DE] Fed. Rep. of Germany ..... 3018644

[51] Int. Cl.[3] ..... G03C 7/00; G03C 5/54; G03C 5/48

[52] U.S. Cl. ..... 430/212; 430/231; 430/219; 430/941

[58] Field of Search ..... 430/213, 231, 219, 941

[56] References Cited

U.S. PATENT DOCUMENTS

| | | | |
|---|---|---|---|
| 3,345,165 | 10/1967 | Land | 430/231 |
| 3,567,442 | 3/1971 | Land | 430/231 |
| 3,721,556 | 3/1973 | Fix | 430/941 |

*Primary Examiner*—John E. Kittle
*Assistant Examiner*—John L. Goodrow
*Attorney, Agent, or Firm*—Connolly and Hutz

[57] ABSTRACT

An image receptor element for the dye diffusion transfer process contains an image-receiving layer, which has increasing dye absorption capacity with increasing distance from the light-sensitive layers. Such an image-receiving layer may be obtained by use of mordants in concentrations which increase with increasing distance from the light-sensitive layers or by use of at least two mordants of different dye absorption capacity, the mordant of higher dye absorption capacity being arranged in a partial layer of the image-receiving layer further away from the light-sensitive layers. Such image receptor elements provide higher dye densities with lower total concentrations of mordants.

4 Claims, No Drawings

IMAGE RECEPTOR ELEMENT FOR THE DYE DIFFUSION TRANSFER PROCESS

This invention relates to a material for the production of color photographic images by the dye diffusion transfer process and in particular to an image receptor element for this material.

For carrying out the dye diffusion transfer process, it is customary to use a recording material containing a light-sensitive element with color-providing compounds and an image receptor element in which the desired color image is produced by the image-wise transfer of diffusible dyes. This requires the establishment of firm contact, at least for a finite period of time within the development time, between the light-sensitive element and the image receptor element so that the image-wise distribution of diffusible dyes produced in the light-sensitive element as a result of development can be transferred to the image receptor element. The contact may be established after development has been started or even before development begins. Contact is established before development begins if, for example, the recording material used for carrying out the dye diffusion transfer process is one in which the light-sensitive element and the image receptor element form an integral unit. Embodiments of the dye diffusion transfer process are known in which such an integral unit is preserved even after development has been completed, i.e. the light-sensitive element is not separated from the image receptor element after transfer of the dyes. Such an embodiment has been described, for example, in German Offenlegungsschrift No. 2,019,430. According to another embodiment, the image receptor element which carries the finished image after transfer of the dyes may be separated from the light-sensitive element, e.g. by means of a stripping layer arranged between the two elements. Such as embodiment has been described, for example, in German Offenlegungsschrift No. 2,049,688 and German Offenlegungsschrift No. 2,647,480.

The color photographic recording material containing the light-sensitive element which has been exposed image-wise is treated with an alkaline developer preparation to develop the silver halide and produce an image-wise distribution of diffusible dyes which is transferred to the image receptor element. The latter consists substantially of a dyeable layer (image receptor layer) arranged on a transparent or opaque layer support. The image receptor element and light-sensitive element may be arranged one above the other on a common layer support or they may be arranged on separate layer supports and joined together, by placing the active surfaces of the layers together, either permanently to form an integral photographic recording material, or only temporarily for the purpose of development and production of the color image, the layers in that latter case being subsequently separated.

The image receptor layer conventionally contains mordants for the diffusible dyes to improve dye absorption. These diffusible dyes are generally anionic dyes. Various monomeric or polymeric cationic compounds are therefore used as mordants, in particular compounds containing quaternary ammonium groups.

It is desirable to obtain color transfer images with as high a color density as possible. An improvement in color density is basically only possible by providing a larger quantity of color-providing compound and consequently a correspondingly larger quantity of developer oxidation products during development. Attempts to increase the maximum color density in the image receptor layer by increasing the quantities of silver halide and dye have only provided unsatisfactory results since they are combined with other disadvantages, such as increased minimum density and, owing to the necessarily higher packing density or thickness of the layers in the light-sensitive element, also an impairment of the color balance and sharpness.

It is an object of this invention to provide an image receptor element for the dye diffusion transfer process with which color image with improved maximum color density can be obtained.

It has now been found that, when producing color images by the dye diffusion process comprising exposure, development and image-wise transfer of a dye or a dye precursor to an image receptor layer, using a photographic recording material having at least one light-sensitive silver halide emulsion layer and a uniformly distributed color-providing compound and an image receptor layer which is capable of absorbing dyes and is firmly connected, either directly or indirectly, with the light-sensitive layer or is only temporarily in contact with it, a substantially higher color density is achieved by using an image receptor layer whose dye absorption capacity varies perpendicularly to the plane of the layer so that the dye absorption capacity increases with increasing distance from the light-sensitive layer or layers. There are basically two methods available for adjusting the dye absorption gradient in the image receptor layer, namely 1. by changing the concentration of one or more mordants for the dyes or dye precursors which are image-wise rendered diffusible during development, which mordants may be homodispersely or heterodispersely distributed in a binder, and are present in increasing concentration with increasing distance from the light-sensitive layers;

2. by using several mordants differing in their mordanting capacity or absorption capacity for the dyes or dye precursor products, the most powerful mordant being contained in that partial layer of the image receptor element which is furthest removed from the layers which provide the dye in image-wise distribution.

These two methods may, of course, also be combined. A wide variety of modifications may be used for adjusting the activity gradient of the mordant in the image receptor element on the basis of the two methods indicated above. Thus, for example, polymeric mordants may be used with or without additional film-forming binders, in which case the functional groups which have a mordanting action, i.e. which fix the dye or dye precursor, e.g. quaternary groups, are contained in the polymer structure in varying molar concentrations. The polymeric mordant containing the highest proportion of mordanting or fixing groups, i.e. the one with the highest dye absorption capacity, should then be arranged furthest away from the layers supplying the dye. Layers according to the invention which have an activity gradient for dye absorption capacity directed perpendicularly to the plane of the layers may constitue an element of several partial layers, i.e. the activity gradients may be discontinuous. This can easily be achieved by casting several partial layers having the required properties one above the other in the order of decreasing (or increasing as the case may be) absorption capacity for the dyes or dye precursors.

Alternatively, an image receptor element may be produced with a mordanting action which has a continuous activity gradient. This may be achieved in known manner by suitable adjustment of the concentration of active compounds in the image receptor element or by suitable measures in the course of production of the element, i.e. when casting the active layers.

The steepness of the activity gradients in the image receptor element according to the invention, i.e. the difference in absorption capacity for dye or dye precursor product between the layers of the element closest to the layers supplying the dyes and those furthest removed from the layers supplying the dyes, may vary within wide limits. The activity gradient will depend on the desired purpose for which the material is to be used, the construction of the dye diffusion material, the properties of the image dyes or dye precursors and the activity of the mordant within the image receptor element. The most suitable choice can be determined by a few simple routine tests. The image receptor element according to the invention obviates the disadvantages of known dye diffusion materials and with relatively simple means achieves color densities which are at least equal to those obtained in conventional photographic color processes with chromogenic development using color couplers. This disadvantage of insufficient color density in the dye diffusion process was particularly serious when the process was used for the production of diffusion copies. When used for the production of color photographic images inside the camera, so-called instant color images, this disadvantage was less obvious to the user because there is no direct comparison with conventional photographic color copies, and rapid production of the image was in any case of greater importance to the user.

The advantage of the process is that processing results in substantially higher color densities in the image receptor element for equal concentrations of dye or dye precursor product and silver halide in the light-sensitive part of the dye diffusion material. It is surprisingly found that in many cases the total concentration of mordant in the image receptor element may be even lower than in conventional mordant layers which have an uniform distribution of mordant. This effect is entirely unexpected since in diffusion processes, e.g. in the silver salt diffusion process, the density of the diffusion image obtained normally depends on the packing density of the active compounds.

The reason for this unexpected effect of the image receptor element according to the invention with differing activity gradients of the dye absorption capacity has not yet been fully clarified. It would appear to be mainly due to the fact that the dye or dye precursor diffusing into the layer is not immediately deposited at a high concentration in the uppermost parts of the image receptor element, and consequently these parts of the layer do not become less permeable to further quantities of active substance and therefore do no prevent further diffusion of substances into the image receptor element. In other words, those parts of the image receptor element facing the layers supplying the dye or dye precursor remain readily permeable to the diffusible active substance so that it can easily diffuse into the lower parts of the image receptor element. The image receptor element is therefore more receptive and can fix a higher concentration of dye or dye precursor.

The image receptor elements according to the invention are prepared in known manner, e.g. by casting the layers from an aqueous solution or dispersion or organic solution.

The total layer thickness of the image receiving layer is within the usual order of, for example, from 5 to 10 μm. The optimum quantity of mordant for achieving the desired high color density in any particular case can be determined by a few simple tests. Quantities of from 0.5 to about 20 g/m$^2$ are generally sufficient, quantities of from 1 to 6 g/m$^2$ being preferred. The image receptor element or partial layers thereof may contain the mordants in quantities of about 1 to 100% by weight, preferably from 20 to 60% by weight, based on the binder in the image receiving layer or its partial layers, depending on the chemical nature of the mordants.

In order to achieve the activity gradient in the image receptor element according to the invention, the mordanting effect may differ widely within the element. It has generally been found satisfactory if the activity of the layer parts of the image receptor element facing the light-sensitive part differs from the activity of the part furthest removed from the light-sensitive part by a factor of 2–20, preferably 2–8. The efficiency of a mordant can be evaluated by a simple test, e.g. when a first image receptor element comprising a (partial) layer which contains the mordant to be evaluated is contacted under standardized conditions with an exposed light sensitive element containing a non-diffusing color providing compound, and after transfer of the dye, is then, still wet contacted with a second standardized image receptor element. The efficiency of the mordant in the first image receptor element can be estimated from the amount of dye transferred to the second image receptor element (measurement of color density). If the same mordant is used in the partial layers of the image receptor element according to the invention it can be assumed that the efficiency is proportional to the concentration of mordant.

The colloidal binders used for the mordants may be the usual ones, e.g. hydrophilic colloids such as proteins, in particular gelatine or albumin, polysaccharides, cellulose derivatives or synthetic homopolymers or copolymers, e.g. polyvinyl compounds such as vinyl alcohol copolymers, copolymers of acrylic or methacrylic acid or derivatives thereof, in particular acrylamide copolymers, and other synthetic polymers.

The image receptor element according to the invention is basically independent of the nature of the mordant used. The mordants may therefore be selected in known manner, primarily on the basis of the chemical properties of the dye or dye precursor which diffuses into the image receiving layer. Since mordanting is in most cases a chemical reaction between the dye and the mordant with the object of spatially fixing the dye, the reactants must be suitably adjusted to each other.

Acid dyes or dye precursors, e.g. compounds containing carboxylic acid or sulfonic acid groups or derivatives thereof, are in most cases used for dye diffusion processes. For fixing these dyes, corresponding mordants having alkaline groups, in particular quaternary ammonium groups, have to be used. Examples of mordants which are suitable for the image receptor element according to the invention are mentioned in the following applications and Patent specifications:

German Offenlegungsschriften Nos. 2,452,447, 2,445,782, 2,551,786, 2,551,790, 2,631,521, 2,651,498, 2,728,844, 2,728,557, 2,843,320, 2,846,044, 2,941,818.

U.S. Pat. Nos. 3,271,147, 3,709,690, 3,770,439, 3,859,096, 3,958,995.

Research Disclosure No. 15,162 (Nov. 1976), pages 75–87, in particular pages 80–82.

The image receptor element according to the invention may be used for dye diffusion processes in general. It may be used within the various known combinations of layers for dye diffusion processes and for various chemical systems supplying dyes or dye precursors. The materials used for the dye diffusion process are basically sub-divided into so-called monoheet materials and so-called two-sheet materials. In monosheet materials (see e.g. German Auslegeschrift No. 1,924,430), image viewing and image exposure may be from opposite sides of the material. This requires a particular arrangement of layers. The light-sensitive part and the image receptor part remain joined together after development. In an other embodiment the image may be viewed from the same side from which the material has been exposed to light.

In so called "two-sheet materials" the light-sensitive element supplying the dyes or dye precursors are in contact with the image receptor element at least during development, the dye being fixed image-wise in the image receptor element, and the light-sensitive part and the image receptor element are separated from each other after processing. See in this connection, for example, U.S. Pat. No. 2,893,606.

If either of these types of materials are used as photographic materials for development inside the camera, an alkaline processing paste contained in a bag is used. The bag is broken by application of pressure after exposure of the material so that the paste can be spread out evenly inside the material and can initiate photographic processing. Dye diffusion processes are, of course, also suitable for copying purposes. In that case the exposed, light-sensitive part is in contact or is brought into contact with the image receptor element at the latest during processing much in the same manner as in the two-sheet material described above, and processing is then carried out with a developer paste or liquid baths. The image receptor element according to the invention is particularly suitable for such copying processes.

The image receptor element according to the invention consists of one or more mordant layers applied to a suitable support. The usual photographic support materials are suitable for this purpose, e.g. paper, baryta paper, plastics laminated paper, pigmented or transparent polymer films, e.g. of polyester such as polyethylene terephthalate, or cellulose acetate, or polycarbonate, or glass roughened aluminum foils. See in this connection the journal "Product Licensing Index", Volume 92, December 1971, pages 107–110. The image receptor element may also contain other layers with different functions, depending on the purpose for which the photographic material is intended, e.g. it may contain so-called retarding or controlling layers, neutralization layers or similar layers known in dye diffusion techniques.

The image receptor element according to the invention may also contain other additives to influence the quality of the color image, e.g. white toners or UV absorbants to improve the stability to light of the color image.

Dye diffusion materials which may be used for the image receptor element according to the invention may consist, for example, of the following elements:

1. A light-sensitive element having a layer support and at least one silver halide emulsion layer applied to the support, either the light-sensitive layer or an adjacent layer containing a compound which releases the image dye or a dye precursor image-wise in the course of processing;

2. The image receptor element according to the invention;

3. Means for photographically processing the dye diffusion material, e.g. aqueous alkaline development baths or containers which can be split open to release an alkaline development paste.

Typical dye diffusion materials for the photographic processes for which the image receptor element according to the invention may be used have been described in, for example, U.S. Pat. Nos. 2,432,181; 2,983,606; 3,227,550; 3,227,552; 3,415,645; 3,415,644; 3,415,646 and 3,635,707, Canadian Pat. No. 674,082 and Belgian Pat. Nos. 757,949 and 757,960.

The silver halide emulsions used in the light-sensitive part of such dye diffusion materials may contain silver chloride, silver bromide or mixtures thereof, optionally with a silver iodide content. Three silver halide emulsion layers are generally used to produce color images in natural colors, namely a blue-sensitive layer to produce the yellow partial color image, a green-sensitive layer to produce the magenta partial color image and a red-sensitive layer to produce the cyan partial color image.

The materials suitable for this purpose are known. To produce the color image, non-diffusing dye-providing compounds are incorporated in the material. After various physical or chemical reactions, these compounds are converted image-wise into a soluble or diffusible form. The diffusible dyes or dye precursors then migrate into the image receiving layer where they are fixed to form the dye image.

Since the dye image contained in the image receptor layer is generally required to be a positive image of the original or of the object photographed, the photographic recording material must generally be so constructed that reversal takes place when the image is formed. This reversal may be achieved either at the exposure stage, by using a positive silver halide emulsion, or at the stage of image-wise formation of the dyes, by choice of suitable chemical systems giving rise to dyes or dye precursors.

If one considers the various types of silver halide which may be used for the dye transfer process, two groups of color transfer materials may be distinguished, namely those for which a positive silver halide emulsion is used and those which contain a negative silver halide emulsion layer.

When positive silver halide emulsions are used, it is necessary to use dye systems which release a diffusible dye image-wise in the exposed areas in proportion to the photographic development taking place there. The so called DDR compounds are suitable for this purpose. Dye-releasing systems of this type have been described in British Pat. No. 904,364, U.S. Pat. Nos. 3,227,550; 3,628,952 and 3,844,785 and German Offenlegungsschriften Nos. 2,317,134 and 2,415,125. Color transfer images of superior quality can be produced with such photographic materials although materials and processes of this type have certain disadvantages, e.g. the relatively long development time and the not quite satisfactory stability of the dye images obtained. For photographic dye transfer materials of the other type, which contain one or more negative silver halide emulsions, it is necessary to use dye providing systems which cause reversal of the image, i.e. the initially non-diffusing dye-providing compounds must give rise to a diffusible dye or dye precursor as a result of a development reaction or secondary reaction which takes place in the unexposed areas when the exposed silver halide emulsion layer is developed, and this diffusible dye or dye precursor must then diffuse into the image receiving layer to produce therein a positive dye image of the original.

Dye-providing compounds of this type include, for example, the so called dye developer compounds. These compounds are soluble and diffusible at the alkaline pH values which prevail during photographic development. They react with the exposed silver halide or with the developer oxidation products in the areas where development takes place and are thereby converted into a diffusion-fast form. Compounds of this type have been described, for example, in U.S. Pat. Nos. 2,983,606 and 3,185,567. Color-providing compounds of another type, which release image dyes with image reversal may also be used in combination with negative silver halide emulsions. Such compounds may be initially contained in a diffusion-fast form in the silver halide emulsion layer or in an adjacent layer and owing to their chemical constitution, are hydrolyzed at the alkaline pH values of photographic development to form a diffusible dye. This splitting reaction substantially only occurs in the unexposed areas, since in the exposed areas the compounds are oxidized by the developer oxidation product and converted into a form which is not decomposed. Compounds of this type have been described in German Offenlegungsschriften Nos. 2,402,900; 2,543,902 and 2,823,159.

Such color-providing compounds which are initially incorporated in the photographic material in a diffusion-fast form by virtue of their ballast groups provide numerous advantages. The compounds described in German Offenlegungsschrift No. 2,402,900 split off diffusible photographically active compounds, in particular dyes or dye precursors, by means of a so-called intramolecular nucleophilic displacement reaction.

Another dye-providing system which results in reversal of the image and may therefore be used with negative silver halide emulsions comprises compounds similar to those mentioned above which, however, in contrast to those are oxidized types of compounds or, stated in more general terms, are reducible compounds. They react neither directly nor indirectly with oxidizing substances, e.g. with the oxidation product of the developer, so that their resistance to diffusion cannot be affected in the exposed areas. They are, however, reactive with reducing compounds, e.g. they are capable of direct or preferably indirect reaction with unused photographic developer which is available in the unexposed areas. The reduction reaction splits the compounds to release a diffusible, photographically active compound, in particular a compound which releases dyes or dye precursors, and this diffusible compound may then diffuse into the image receiving layer to be fixed there.

It is particularly preferred to use such compounds in combination with an electron donor compound (ED compound) or electron donor precursor compound (ED precursor compound) which supplies the electrons required for the dye-releasing reaction.

If, therefore, the photographic material containing the last mentioned compound also contains an ED compound or ED precursor compound in image-wise distribution, the reaction of the ED compound with the non-diffusing color-providing compound releases diffusible, photographically active compounds. Thus, diffusible, photographically active compounds, in particular dyes, are obtained in the same image-wise distribution. Dye-forming systems operating on the last mentioned principle have been described, for example, in German Offenlegungsschrift No. 2,809,716, German Patent Applications Nos. P 30 08 588.2 and P 30 14 669.1 and European Published Application No. 0,004,399.

Dye diffusion materials containing the image receptor element according to the invention, used for example, for taking original photographs, may also contain acid layers or so-called retarding layers in known manner, which together form the so-called neutralization system. Such an integral neutralization system may be arranged in known manner between the layer support and the image receiving layer on it, or they may be arranged in some other position in the layers, e.g. above the light-sensitive layers, i.e. on the far side of the light-sensitive layers, viewed from the side of the image receiving layer. The neutralization system is normally orientated so that the retarding layer is situated between the acid layer and the position where the alkaline development liquid or paste comes into operation. Such acid layers, retarding layers, etc., and neutralization systems consisting of both, have been disclosed, for example, in U.S. Pat. Nos. 2,584,030; 2,983,606; 3,362,819 and 3,362,821 and German Offenlegungsschriften Nos. 2,455,762; 2,601,653; 2,716,505 and 2,816,878.

Such a neutralization system may also contain two or more retarding layers in known manner.

Materials for the dye diffusion process containing the image receptor element according to the invention may also contain one or more pigmented opaque layers which are permeable to aqueous liquids. These may fulfill two functions. Firstly, they may prevent the unwanted access of light to light-sensitive layers, and, secondly, such pigmented layers, particularly if they contain a light or white pigment such as $TiO_2$, may form an aestetically pleasing background for the color image produced. Integral color photographic recording materials containing such a layer of pigment are known, e.g. from U.S. Pat. No. 2,543,181 and German Auslegeschrift No. 1,924,430. Instead of providing a preformed opaque layer, means may be provided to produce such a layer in the course of the development process. In accordance with their two functions mentioned above, such pigment layers may be composed of two or more partial layers, one of which, for example, may contain a white pigment and the other, for example, a dark, light-absorbent pigment, e.g. carbon black.

As already mentioned above, the image receptor elements according to the invention may also be used for so-called integral dye diffusion materials which may comprise, for example, the following layer elements:

1. a transpatent layer support
2. an image receiving layer
3. a light impermeable layer
4. a light-sensitive element having at least one light-sensitive silver halide emulsion layer and at least one non-diffusible color-providing compound associated therewith
5. a retarding layer
6. an acid polymer layer
7. a transparent layer support.

The image receptor element according to the invention may also be used for dye diffusion processes and corresponding materials of the type described in U.S. Pat. No. 3,620,731.

The image receptor elements according to the invention are suitable in particular for dye transfer processes and materials in which the light-sensitive element and the image receptor element are arranged on a layer support in such a manner that the light-sensitive element can be stripped off or washed off after processing. This is most simply achieved by arranging a so-called stripping layer between the two elements. Materials and processes of this kind have been described, for example, in the above-mentioned German Offenlegungsschrift Nos. 2,049,688 or 2,647,480.

EXAMPLE 1

Two mordant layers of the following composition are applied to a layer support of polyethylene-coated paper which is coated with a substrate layer:

Mordant Layer A 300 ml of 15% aqueous gelatine solution
600 ml of a 5% aqueous solution of compound I (see end of Example)
12 ml of a 10% aqueous saponin solution
Wet application 132 g/m$^2$.

Mordant Layer B

The following partial layers are applied one after the other:

(a)

300 g of gelatine 15%
600 ml of solution of compound I 5%
12 ml of saponin solution 10%
Wet application 33 g/m$^2$ (b)

300 ml of gelatine 15%
300 ml of solution of compound I 5%
300 ml of water
12 ml of saponin solution 10%
Wet application 33 g/m$^2$ (c)

300 ml of gelatine 15%
150 ml of solution of compound I 5%
450 ml of water
12 ml of saponin solution 10%
Wet application 33 g/m$^2$ (d)

300 ml of gelatine 15%
75 ml of solution of compound I 5%
525 ml of water
12 ml of saponin solution 10%
Wet application 33 g/m$^2$ The mordant layers are then coated with an aqueous solution of a hardener having the following composition:

Hardener Solution 600 ml of a 1% aqueous solution of compound II (for formula see below)
6 ml of a 10% aqueous saponin solution.

This solution is applied in a quantity containing a quantity of hardener which amounts to about 5% of the weight of gelatine in the mordant layer.

A stripping layer having the following composition may then be applied to the hardened mordant layer, if required:

Stripping Layer 1000 ml of phthaloyl gelatine 2%
12 ml of saponin 10%
Wet application 50 g/m$^2$ When the mordant layers have been prepared as described above, the dye emulsion layer is applied as follows:

Cyan layer

A red-sensitized silver halide emulsion (89% AgBr, 10% AgCl, 1% AgI) containing a cyan dye of formula III (see below) in the form of a dispersion in gelatine is applied in accordance with the following particulars:
Wet application: 50 g/m$^2$
Silver application: 0.7 g $AgNO_3$/m$^2$
Dye III: 0.6 g/m$^2$
$AgNO_3$: gelatine = 1:1.

Protective layer 1000 ml of gelatine 15%
6 ml of saponin 10%
Wet application: 50 g/m$^2$.

The two arrangements of layers prepared as described above are exposed through a step wedge and then developed at 22° C. in a developer prepared according to the following formulation:
0.5 g of 1-phenyl-3-pyrazolidone
0.1 g of hydroquinone
25 g of NaOH
4 g of sodium sulfite
1 g of benzotriazole
10 ml g of benzyl alcohol
made up to 1000 ml with water.

The emulsion layers are then washed with warm water at 50°–60° C. Two color wedges having the following maximum densities are obtained:

| | Experiment 1 | Experiment 2 |
|---|---|---|
| Mordant layer A | 1.0 | 1.0 |
| Mordant layer B | 1.3 | 1.5 |

Compound I

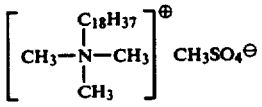

Compound II

-continued

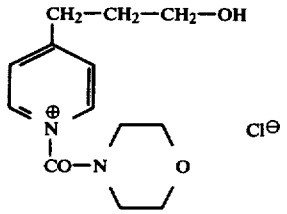

Compound III

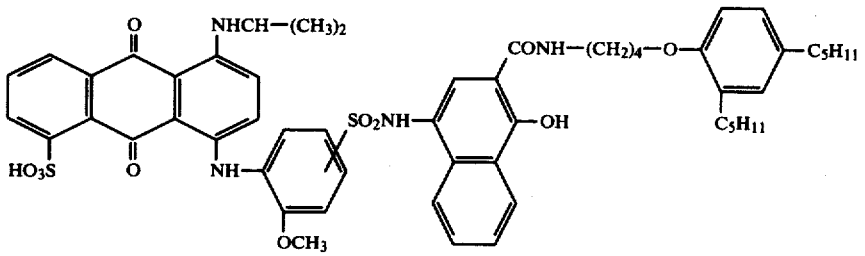

EXAMPLE 2

The following emulsion layer and protective layer are applied to the two mordant layers described in Example 1:

Magenta Layer

A green-sensitized silver halide emulsion (88.3% AgBr, 11% AgCl, 0.7% AgI) containing a magenta dye of formula IV (see below) was prepared in the form of a dispersion in gelatine and applied in accordance with the following particulars:

Wet application: 50 g/m$^2$
Silver application: 0.7 g of $AgNO_3$/m$^2$
dye IV: 0.6 g/m$^2$
$AgNO_3$: gelatine = 1:1

Protective layer

The same as for the cyan layer in Example 1.

The two arrangements of layers were processed as described in Example 1.

The following maximum densities are obtained:
Mordant layer A = 1.3
Mordant layer B = 1.48

Compound IV

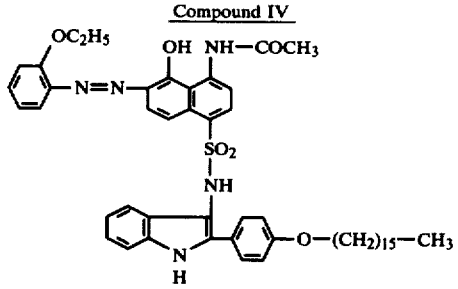

EXAMPLE 3

Two mordant layers having the following composition are applied to a layer support of polyethylene-coated paper having a substrate layer:

Mordant layer C 700 ml of a 7% aqueous gelatine solution
200 ml of a polymeric mordant according to German Auslegeschrift No. 2,631,521, Example 1, 25%.
12 ml of a 10% aqueous saponin solution
Wet application 110 g/m$^2$

Mordant layer D

The following partial layers are applied in succession:

(a)

700 ml of gelatine 7%
200 ml of polymer mordant according to German Auslegeschrift No. 2,631,521, Example 1
12 ml of saponin 10%
Wet application 27 g/m$^2$ (b)

800 ml of gelatine 7%
100 ml of polymer mordant according to German Auslegeschrift No. 2,631,521, Example 1.
12 ml of saponin 10%
Wet application 33 g/m$^2$ (c)

850 ml of gelatine 7%
50 ml of polymer mordant according to German Auslegeschrift No. 2,631,521, Example 1
12 ml of saponin 10%
Wet application 37 g/m$^2$ (d)

875 ml of gelatine 7%
25 ml of polymer mordant according to German Auslegeschrift No. 2,631,521, Example 1
12 ml of saponin 10%
Wet application 40 g/m$^2$ The mordant layers are then treated according to Example 1 with a hardener solution, then with a stripping layer, followed by a cyan emulsion and finally a protective layer. Processing is carried out as in Example 1.

The following maximum densities are obtained:
Mordant layer C = 1.10

Mordant layer D = 1.35

We claim:

1. An image receptor element for dye diffusion transfer process with diffusible dye anions comprising a support and at least one image receiving layer containing as a mordant for said dye anions, means for providing in the image receiving layer a dye absorption capacity which is variable normal to the plane of the layer in the direction of diffusion of the dye anions into the image receiving layer during processing from a light sensitive element which is in alkali permeable contact with the image receiving layer, said means comprising cationic groups reactable with the diffusible dye anions and distributed in the image receiving layer so as to provide an increase in the dye absorption capacity extending through the image receiving layer normal to the plane of the layer and with increasing distance from the contact.

2. A photographic material for dye diffusion with diffusible dye anions process, comprising at least one light-sensitive silver halide emulsion layer and associated to it a uniform distribution of a color-providing compound, and a supported image receptor element having at least one image receiving layer containing as a mordant for said dye anions, means for providing in the image receiving layer a dye absorption capacity which increases normal to the plane of the layer in the direction of diffusion of the dye anions into the image receiving layer during processing away from a light sensitive element which is in alkali permeable contact with the image receiving layer, said means comprising cationic groups reactable with the diffusible dye anions and distributed in the image receiving layer so as to provide an increase in dye absorption capacity extending through the image receiving layer normal to the plane of the layer and with increasing distance from the contact.

3. A photographic material as claimed in claim 2 in which the image receiving layer contains at least a first mordant having cationic groups of higher dye absorption capacity contained in a partial layer located further removed and a second mordant having cationic groups of lesser dye absorption capacity contained in a partial layer located less removed from the contact with the light sensitive element.

4. A photographic material as claimed in claim 2, in which the image-receiving layer of the image receptor element contains said mordant for diffusible dye anions in increasing concentration with increasing distance from the contact with the light-sensitive element.

* * * * *